US008887336B2

(12) United States Patent
Pezzani et al.

(10) Patent No.: US 8,887,336 B2
(45) Date of Patent: Nov. 18, 2014

(54) HOSPITAL BED

(76) Inventors: Joan Pezzani, Hillsboro, MO (US); Martin Pezzani, Hillsboro, MO (US)

( * ) Notice: Subject to any disclaimer, the term of this patent is extended or adjusted under 35 U.S.C. 154(b) by 0 days.

(21) Appl. No.: 13/301,754

(22) Filed: Nov. 21, 2011

(65) Prior Publication Data

US 2012/0124750 A1 May 24, 2012

Related U.S. Application Data

(60) Provisional application No. 61/415,931, filed on Nov. 22, 2010.

(51) Int. Cl.

| | |
|---|---|
| ***A47C 31/00*** | (2006.01) |
| ***A61G 7/05*** | (2006.01) |
| ***A61G 11/00*** | (2006.01) |
| ***A61G 13/10*** | (2006.01) |

(52) U.S. Cl.

CPC *A61G 7/05* (2013.01); *A61G 11/00* (2013.01); *A61G 13/107* (2013.01); *A61G 2200/14* (2013.01); *A61G 2203/30* (2013.01)

USPC ..... 5/658; 5/496; 5/603

(58) Field of Classification Search

USPC ..... 5/691, 692, 488, 494, 495, 496, 497, 5/499, 655, 658, 603; 600/21, 22; 128/845, 897

See application file for complete search history.

(56) References Cited

U.S. PATENT DOCUMENTS

| | | | | |
|---|---|---|---|---|
| 5,056,533 | A * | 10/1991 | Solano | 5/627 |
| 5,722,100 | A * | 3/1998 | Jozwiak | 4/572.1 |
| D393,561 | S * | 4/1998 | Hayes | D6/596 |
| 7,533,425 | B2 * | 5/2009 | Monti et al. | 4/572.1 |
| 2007/0079444 | A1 * | 4/2007 | Ward | 5/655 |
| 2008/0163425 | A1 * | 7/2008 | White | 5/603 |
| 2009/0172881 | A1 * | 7/2009 | Peterson | 5/496 |

* cited by examiner

*Primary Examiner* — William Kelleher
*Assistant Examiner* — Richard G Davis
(74) *Attorney, Agent, or Firm* — Zackson Law LLC; Saul L. Zackson

(57) ABSTRACT

The present inventors disclose a bed comprising a bed insert and a base. An insert comprises one or more openable loops which can receive medical tubing or other types of medical lines. In some configurations, the one or more openable loops can be reversibly attached to the insert. An insert can be attached to the base by a reversible attachment such as Velcro. A patient, along with an insert, can be lifted from the base. A patient who has medical lines which extend through the loops can be lifted with the insert from the base without disrupting connections between the medical lines and the patient.

14 Claims, 7 Drawing Sheets

HOSPITAL BED

PRIORITY

The present application claims priority to U.S. Provisional Patent Application 61/415,931 filed Nov. 22, 2010. Patent Application 61/415,931 is incorporated by reference herein in its entirety.

INTRODUCTION

A person occupying a bed, such as, for example, a hospital patient, often has tubing, wires, and other lines extending between his or her body and external equipment, such as, for example, a source of intravenous fluid. In many cases a person can have multiple lines. A person occupying a bed can be, for example, a pediatric patient, a geriatric patient, a military veteran, or a middle-aged patient. In many cases, when someone such as a hospital patient has multiple lines attached to his or her body, the lines can pose difficulties for the person, and for others such as visitors, nurses, doctors, and other treatment providers. These difficulties can include, for example; tangles and pinching of a tube. Friction between tubing and other equipment can also contribute to difficulties in moving patients. Furthermore, moving or lifting the person can be difficult, slow, and/or dangerous.

U.S. Pat. No. 5,471,689 to Shaw et al. discloses a bed handle system which includes a pair of handle elements, and is used for facilitating movement into and out of a bed. U.S. Pat. No. 7,818,831 to Mandjoubi discloses a hospital bed and system for transferring a patient from one bed to another. However, neither of these patents discloses a bed insert comprising a frame comprising a front panel, a left panel, a right panel and a rear panel, and one or more openable loops attached thereto.

SUMMARY

The present inventors disclose a bed comprising a bed insert and a base (FIG. 1, FIG. 3). In various configurations, a bed of the present teachings can comprise cloth and/or plastic. In various aspects, an insert comprises one or more loops into which medical tubing or other types of lines can be inserted. In various configurations, the one or more loops can be rigidly positioned against the insert. In various configurations, the one or more loops can be rigidly positioned substantially vertically with respect to the insert. A bed of the present teachings can be made using standard materials and methods known to persons of skill in the art. A bed of the present teachings can be used in a home, or in a care facility such as a hospital or a nursing home. In some configurations, a bed of the present teachings can be made entirely without metal. It can be used, in non-limiting example, to facilitate positioning of a pediatric patient in an MRI apparatus. In various configurations of the present teachings, a patient can receive an MRI scan while lying in the insert, with medical tubing attached.

In various aspects of the present teachings, an insert can be secured to a base by an attachment such as Velcro and/or a catch latch. In some configurations, both the base and the insert can be placed on top of a bed such as a hospital bed.

In various configurations, an insert can have dimensions appropriate for the size of an individual. For example, for a pediatric patient, the insert can be about 35"×about 21"× about 1". In some configurations, the insert can be 35"×21"× 1". In other configurations, an insert can be at least 20" in length up to 80" in length. In other configurations, an insert can be at least 24" in length up to 70" in length. In other configurations, an insert can be at least 20" in length up to 50" in length. In other configurations, an insert can be at least 20" in length up to 50" in length. In other configurations, an insert can be at least 30" in length up to 40" in length. In other configurations, an insert can be at least 34" in length up to 36" in length. In other configurations, an insert can be about 35" in length. However, an insert in various configurations can be of greater or shorter length, greater or shorter width, and/or greater or shorter depth. In some configurations, an insert can comprise soft bedding material. In some configurations, an insert can be made with materials that facilitate rapid clean-up, such as plastic. In some configurations, the bedding material can be quilted, such as, for example, soft quilted or plastic quilted. In some configuration, the quilting material can comprise plastic that can facilitate clean up. In various configurations, a bed insert can comprise a lip which can run around one or more sides of the insert. In some configurations, a lip can run around the entire insert. In some configurations, all or part of a lip can be about 2" in width, or 2" in width. In some configurations, all or part of a lip can be about 1" in width, or 1" in width. In various configurations, a lip can be made from any rigid material such as, for example, wood, plastic or metal. In some configurations, a lip can be made from a rigid material such as wood or plastic.

In various aspects, an insert can be configured to be detachable from the base. In some configurations, an insert can be reversibly attached to a base, using one or more reversible attachments such as Velcro and/or a catch clip.

In various aspects, an insert of the present teachings can include one or more reversibly openable loops. In some configurations, each loop of the one or more loops can be a reversibly openable loop. In various configurations, a loop can be detachably attached to an insert. In some configurations, a loop can be a ring, i.e., a loop ring. In various configurations, a ring can be toroidal, ovoid or another topologically closed shape that can be openable and can receive one or more lines such as, for example, intravenous tubes, drainage tubes or wires. In various configurations, a ring can have a diameter of from about 2" up to about 3", up to about 4", up to about 5", or up to about 6". In non-limiting example, a ring can be a 2" diameter ring, a 3" diameter ring, a 4" diameter ring, a 5" diameter ring, or a 6" diameter ring. In non-limiting example, a 2" ring can accommodate up to about 5 tubings. In various configurations, an insert can include one, two, three, four, five, six, seven, eight, nine, ten, eleven, or twelve loops such as loop rings. In some configurations, an insert can have six loops, including, for example, two loop rings for each side and two loop rings for the head of the insert (FIG. 5).

In various configurations, a loop can be reversibly openable and can receive medical lines and tubings (FIG. 1, FIG. 7, and FIG. 8). As shown in FIG. 7 and FIG. 8, a loop can be a clip, such as, for example, a 2" diameter round plastic clip. In various configurations, a loop can comprise plastic, metal, or a combination thereof. In some configurations, a loop can comprise plastic, such as polished plastic. In some configurations, a clip can include a reversibly closed opening, for example a hinge such as a spring hinge, and/or a clasp and/or a pin and clip snap lock. In some configurations, a loop secured on an insert can have a reversibly closed opening which can facilitate placement or removal of lines in the loop (FIG. 1). In some configurations, loops can be color coded, so that different colored loops can indicate the purposes of lines held by the loops.

In some aspects, an insert can include means for attaching one or more loops. In various configurations, a means for attaching a loop to the frame of an insert can also be a means for securing a loop in a substantially vertical position on the frame. In some configurations, a means for attaching a loop to the frame can be a means for reversibly attaching the loop to the frame. In some configurations, a means for attaching a loop to an insert can be, without limitation, a slot or groove in the lip, a magnet, or a plate that can be sewn in or secured by a bolt and nut. In various configurations, a slot or groove can be from about 1" in length up to about 6" in length, in non-limiting example, 1", 2", 3", 4", 5", or 6" in length. A slot or groove can be from about a quarter inch up to about 4" in depth, in non-limiting example, ¼", ½" ¾", 1", 2", 3", or 4" in depth. In various configurations, a slot or groove can have a width that corresponds to that of a loop. In some configurations, a slot or groove can have a shape that corresponds to the shape of a loop, for example an arc that corresponds to, and can receive, a circular loop. In some configurations, a plate can comprise a rigid material such as wood or plastic. For example, a plate can be a square, a rhombus, a rectangle, a triangle, or a circular piece of plastic or wood. In non-limiting example, a plate can be a circle 2" in diameter having a ¼" hole; a bolt, and a nut can be used to secure a loop against an insert. For example, a combination of a bolt, washers and a wingnut can be used to secure a plate to the frame of the insert. A loop can be positioned between the frame and the plate, and secured in position by tightening the nut, i.e., a loop can be held by pressure between the plate and the frame of the insert. In some configurations, a loop can be released by loosening the wingnut. In various configurations, screws, washers, nuts, bolts, or other hardware can be metal or plastic. In other configurations, a spring can be used to hold a plate against a loop.

In various configurations, a base can have dimensions appropriate for the size of an individual. In various aspects, a bed of the present teachings can have a base of about 32"× about 16"×about 4". In some configurations, the base can be 32"×16"×4". In various aspects, a base can comprise a ridge running down each of the left side and the right side. In some configurations, the lip can be a 1" lip. In various aspects, an insert can sit stationary on a base. In some configurations, all materials can be non-metallic, and can include, for example and without limitation, plastic, wood, cloth, and/or Styrofoam. Cloth can be any cloth known to skilled artisans, such as, for example, cotton, linen, wool, and/or a synthetic polymer such as nylon.

In some configurations, an insert can be soft and can collapse like a quilt when, for example, a parent holds a child patient.

In various configurations, an insert of the present teachings can facilitate the lifting of person such as, for example, a pediatric patient. In some configurations, straps comprised by an insert, such as two straps, one on each side, can facilitate lifting. For example, in some configurations, a patient such as a child can be lifted off the base on the insert. In some configurations, a patient can be lifted with the aid of two straps, one on each side. In some embodiments, an insert, along with loops, can be detached from a base; the loops can move with the insert. For example, if the insert is attached to the base by a Velcro strip, the insert can be removed from the base by lifting, without damage to either the insert or the base.

In various configurations, a patient such as a child can be lifted along with the insert including the loops. In some configurations, the insert with the loops can facilitate repositioning of the patient, such as, for example and without limitation, a child, an elderly person or a disabled veteran. In non-limiting example, an insert of the present teachings can facilitate the placement of a child by a doctor or nurse into the arms of a parent, while the child is connected with lines such as medical tubing. In various embodiments, medical lines can stay in place with the loops on the insert, while maintaining connections, e.g., to pumps or other medical equipment, and also without disrupting connections to the patient. In some configurations, an insert can facilitate placement of a patient such as a child back into its bed.

Use of an insert can, in some configurations, facilitate rapid, efficient placement of a patient such as a child into or onto a bed. In non-limiting example, in an emergency, a nurse can place the child back in bed, and can do so rapidly.

Loops of the present teachings can receive any flexible medical line, such as, for example and without limitation, intravenous lines, drainage lines, or wires for electrocardiography.

The present teachings include, without limitation, the following aspects.

1. A bed insert comprising:
   a frame comprising a front panel, a left panel, a right panel and a rear panel; and one or more openable loops.
2. A bed insert of aspect 1, wherein one or more panels comprise means for detachably securing the one or more openable loops to the frame.
3. A bed insert of aspect 1, wherein each loop of the one or more loops can be a ring.
4. A bed insert of aspect 1, wherein each loop of the one or more loops can be a reversibly openable ring.
5. A bed insert of aspect 4, wherein each loop of the one or more openable loops can receive flexible tubing.
6. A bed insert of aspect 5, wherein the tubing can be medical plastic tubing.
7. A bed insert of aspect 1, wherein each loop of the one or more loops can be an openable ring comprising plastic, metal or a combination thereof.
8. A bed insert of aspect 1, wherein each loop of the one or more loops can be an openable ring comprising plastic.
9. A bed insert of aspect 8, wherein a loop can be an openable ring comprising plastic and can receive plastic tubing through an opening.
10. A bed insert of aspect 9, wherein the plastic can be a polished plastic.
11. A bed insert of aspect 1, wherein each loop of the plurality of loops can be an openable clip.
12. A bed insert of aspect 11, wherein each openable clip can be independently selected from the group consisting of a hinged clasp and a pin-and-clip snap lock.
13. A bed insert of aspect 12, wherein a pin-and-clip snap lock can comprise a spring hinge.
14. A bed insert of aspect 2, wherein the means for detachably securing the one or more loops can be a means that detachably secures the one or more loops in a substantially upright or vertical position.
15. A bed insert of aspect 1, wherein a loop can be an openable ring of from about 1" in diameter to about 4" in diameter.
16. A bed insert of aspect 1, wherein a loop can be an openable ring of from about 2" in diameter to about 3" in diameter.
17. A bed insert of aspect 2, wherein the means for detachably securing the one or more loops comprises one or more slots.
18. A bed insert of aspect 17, wherein each slot of the one or more slots can be configured to receive a loop of the plurality of loops.
19. A bed insert of aspect 17, wherein each panel independently comprises zero, one, two, three or four slots.
20. A bed insert of aspect 17, wherein each panel independently comprises zero, one, two or three slots.
21. A bed insert of aspect 17, wherein each panel independently comprises two or three slots.

22. A bed insert of aspect 17, wherein each panel comprises zero or two slots.
23. A bed insert of aspect 17, wherein three panels comprises two slots.
24. A bed insert of aspect 17, wherein each of the front panel, the left panel, and the right panel comprises two slots.
25. A bed insert of aspect 1, wherein each of the front panel, the left panel and the right panel can be about 2" in width.
26. A bed insert of aspect 1, wherein each of the front panel, the left panel, the right panel and the rear panel can be about 2" in width.
27. A bed insert of aspect 1, further comprising bedding material.
28. A bed insert of aspect 27, wherein the bedding material can comprise a quilted material.
29. A bed insert of aspect 27, wherein the bedding material can comprise a hypoallergenic material.
30. A bed insert of aspect 27, wherein the bedding material can comprise polyfill.
31. A bed insert of aspect 1, further comprising Velcro for attaching the bed insert to a base.
32. A bed insert of aspect 31, wherein the attachment comprises Velcro strips.
33. A bed insert of aspect 1, further comprising a catch clip for attaching the bed insert to a base.
34. A bed insert of aspect 1, wherein one or more panels further comprises one or more straps.
35. A bed insert of aspect 34, wherein the one or more straps can each be from 5" to 6" in length.
36. A bed insert of any one of aspects 1-35, wherein the left panel and the right panel are of equal length.
37. A bed insert of any one of aspects 1-36, wherein the left panel and the right panel can each be from at least 20" up to 80" in length.
38. A bed insert of any one of aspects 1-36, wherein the left panel and the right panel can each be from 20" up to 72" in length.
39 A bed insert of any one of aspects 1-36, wherein the left panel and the right panel can each be from 24" up to 70" in length.
40. A bed insert of any one of aspects 1-36, wherein the left panel and the right panel can each be from 20" up to 50" in length.
41. A bed insert of any one of aspects 1-36, wherein the left panel and the right panel can each be from 30" up to 40" in length.
42. A bed insert of any one of aspects 1-36, wherein the left panel and the right panel can each be from 32" up to 38" in length.
43. A bed insert of any one of aspects 1-36, wherein the left panel and the right panel can each be from 34" up to 36" in length.
44. A bed insert of any one of aspects 1-36, wherein the left panel and the right panel can each be about 35" in length.
45. A bed insert of any one of aspects 1-44, wherein the front panel and the rear panel can each be from at least 12" up to 36" in length.
46. A bed insert of any one of aspects 1-44, wherein the front panel and the rear panel can each be from at least 15" up to 32" in length.
47. A bed insert of any one of aspects 1-44, wherein the front panel and the rear panel can each be from at least 16" up to 30" in length.
48. A bed insert of any one of aspects 1-44, wherein the front panel and the rear panel can each be from at least 18" up to 26" in length.
49. A bed insert of any one of aspects 1-44, wherein the front panel and the rear panel can each be from at least 19" up to 24" in length.
50. A bed insert of any one of aspects 1-44, wherein the front panel and the rear panel can each be from at least 20" up to 23" in length.
51. A bed insert of any one of aspects 1-44, wherein the front panel and the rear panel can each be about 21" in length.
52. A bed comprising:
the bed insert of any one of aspects 1-51; and
a base comprising a left side and a right side.
53. A bed of aspect 52, wherein the left side and the right side of the base each comprises a lip.
54. A bed of aspect 53, wherein each lip comprises one or more Velcro strips.
55. A bed of aspect 53, wherein each lip comprises at least two Velcro strips.
56. A bed of aspect 54 or aspect 55, wherein each Velcro strip can be from about 2" to about 10" in length.
57. A bed of aspect 54 or aspect 55, wherein each Velcro strip can be from about 3" to about 9" in length.
58. A bed of aspect 54 or aspect 55, wherein each Velcro strip can be from about 4" to about 8" in length.
59. A bed of aspect 54 or aspect 55, wherein each Velcro strip can be from about 5" to about 7" in length.
60. A bed of aspect 54 or aspect 55, wherein each Velcro strip can be about 6" in length.
61. A bed of any one of aspects 52-60, wherein the lips can each be about 1" in width.
62. A bed of any one of aspects 52-61, wherein the base can be from 20"up to 80" in length.
63. A bed of any one of aspects 52-61, wherein the base can be from 22" up to 72" in length.
64. A bed of any one of aspects 52-61, wherein the base can be from 24" up to 60" in length.
65. A bed of any one of aspects 52-61, wherein the base can be from 25" up to 48" in length.
66. A bed of any one of aspects 52-61, wherein the base can be from 27" up to 40" in length.
67. A bed of any one of aspects 52-61, wherein the base can be from 30" up to 36" in length.
66. A bed of any one of aspects 52-61, wherein the base can be about 32" in length.
67. A bed of any one of aspects 52-66, wherein the base can be from 12" up to 30" in width.
68. A bed of any one of aspects 52-66, wherein the base can be from 14" up to 24" in width.
69. A bed of any one of aspects 52-66, wherein the base can be from 15" up to 20" in width.
70. A bed of any one of aspects 52-66, wherein the base can be about 16" in width.
71. A bed of any one of aspects 52-70, wherein the base can have a depth of from 2" up to 8".
72. A bed of any one of aspects 52-70, wherein the base can have a depth of from 3" up to 6".
73. A bed of any one of aspects 52-70, wherein the base can have a depth of about 4".
74. A bed of any one of aspects 52-73, wherein the base has dimensions of about 32" by about 16" by about 4".
75. A bed of any one of aspects 52-73, wherein the base has dimensions of 32" by 16" by 4".
76. A bed of any one of aspects 52-74, having dimensions of about 34" by about 17" by about 5½".
77. A bed of any one of aspects 52-74, having dimensions of 34" by 17" by 5½".
78. A bed of any one of aspects 52-77, wherein the insert and the base are attached.

79. A bed of any one of aspects 52-77, wherein the insert and the base are attached by Velcro.

80. A bed of any one of aspects 52-77, wherein the insert and the base are attached by an attachment selected from the group consisting of Velcro and a catch latch.

81. A bed insert of any one of aspects 1-51, having dimensions of about 35" by about 21" by about 1".

DETAILED DESCRIPTION

Figure 1:
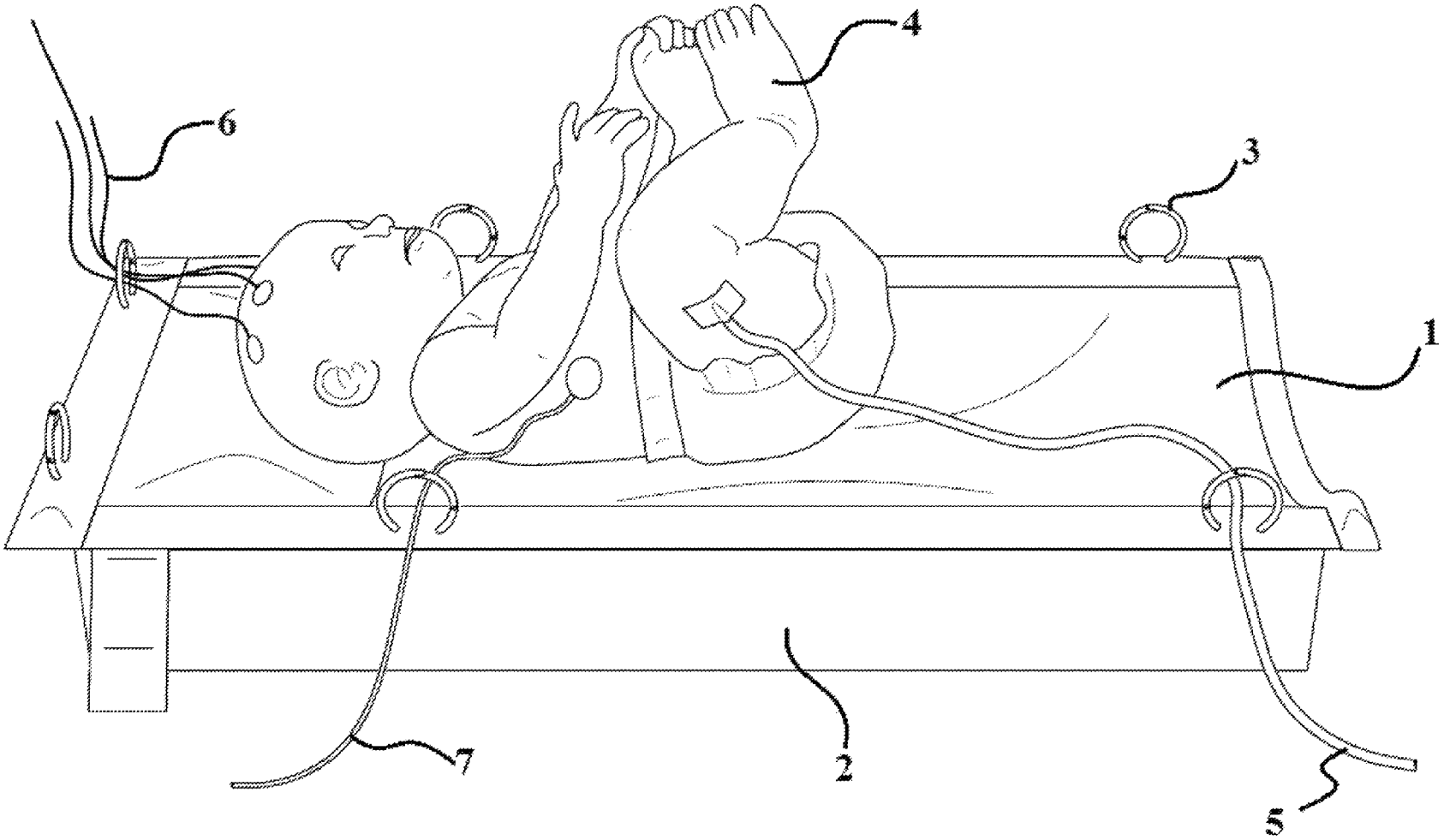
FIG. 1 illustrates a bed of the present teachings.
Figure 2:
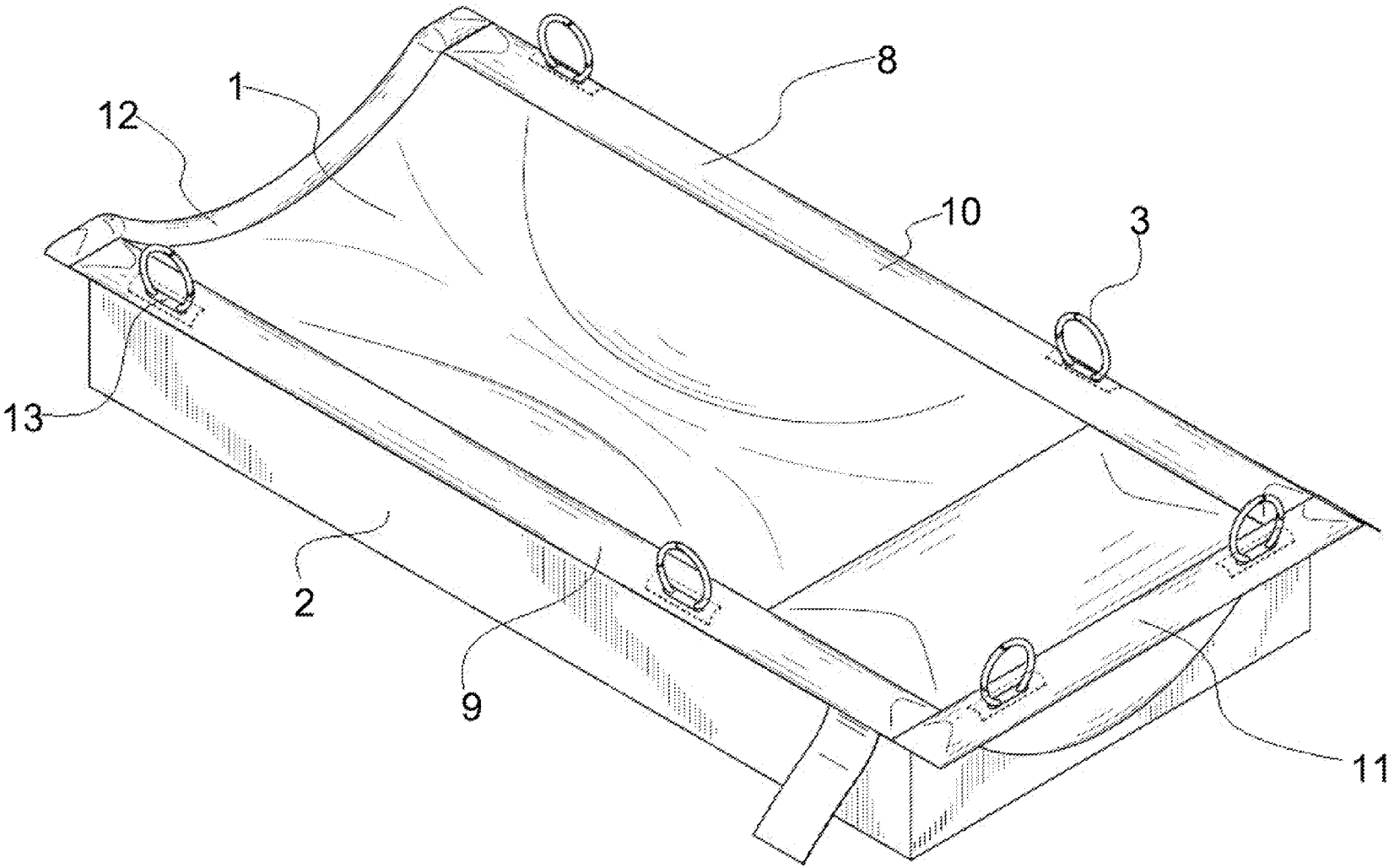
FIG. 2 illustrates a side view of a configuration of an insert and a base.
Figure 3:
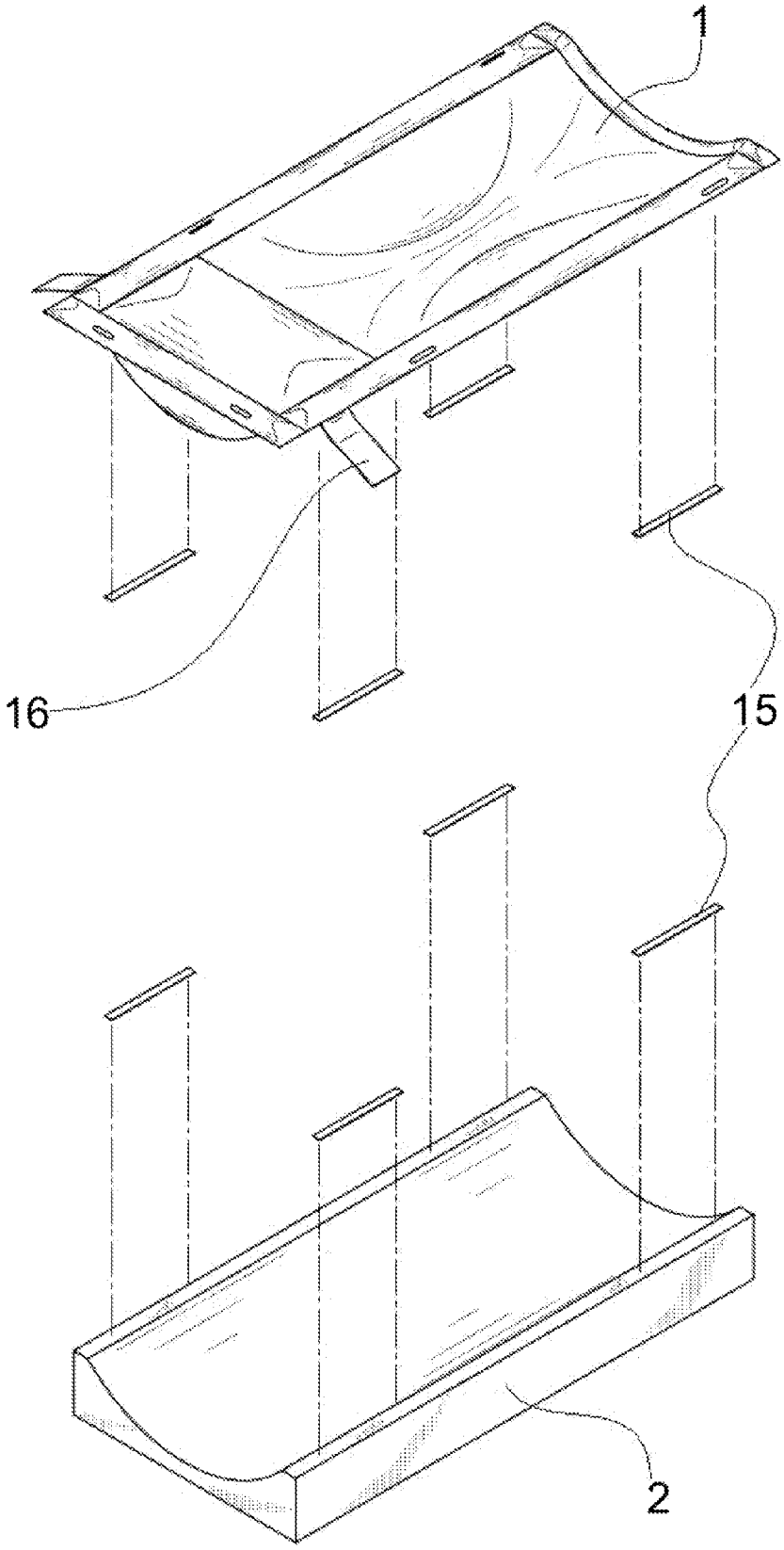
FIG. 3 illustrates an exploded view of an insert and a base.

Disclosed herein is a bed comprising a bed insert and a base (FIG. 1, FIG. 3). A bed of the present teachings can be suitable for use in a care facility such as, for example, a hospital, a nursing home, or a rehabilitation unit. A bed of the present teachings can also be suitable for home use. As exemplified in FIG. 1, a bed of the present teachings can comprise a bed insert 1, a base 2, and one or more openable loops 3. In various configurations, a patient 4 can lie on top of the bed insert 1 wherein tubing 5, wires 6, and/or other lines 7, which may be attached to the patient 4, can extend through openable loops 3. As illustrated in FIG. 1 and FIG. 2, a bed insert 1, can lie on the base 2.

As exemplified in FIG. 2, in various embodiments of the present teachings, a bed insert 1 can further comprise a frame 8. A frame 8 can comprise a left panel 9, a right panel 10, front panel 11, and a rear panel 12. In various configurations, one or more panels can include means for detachably securing one or more openable loops 3 to the frame. Means for securing a loop can be, for example, a plate or block comprising a slot 13 proportioned to receive a loop. A plate can be, without limitation, a substantially rectangular block. In various configurations, a plate of the present teachings can be configured to receive a loop. In some aspects, a plate can be a slotted plate configured to receive and hold a loop. A plate of the present teachings can be made of any suitable hard material such as, without limitation, plastic or wood. A plate can be secured to the frame by stitching, gluing or other attachments.

Figure 4:
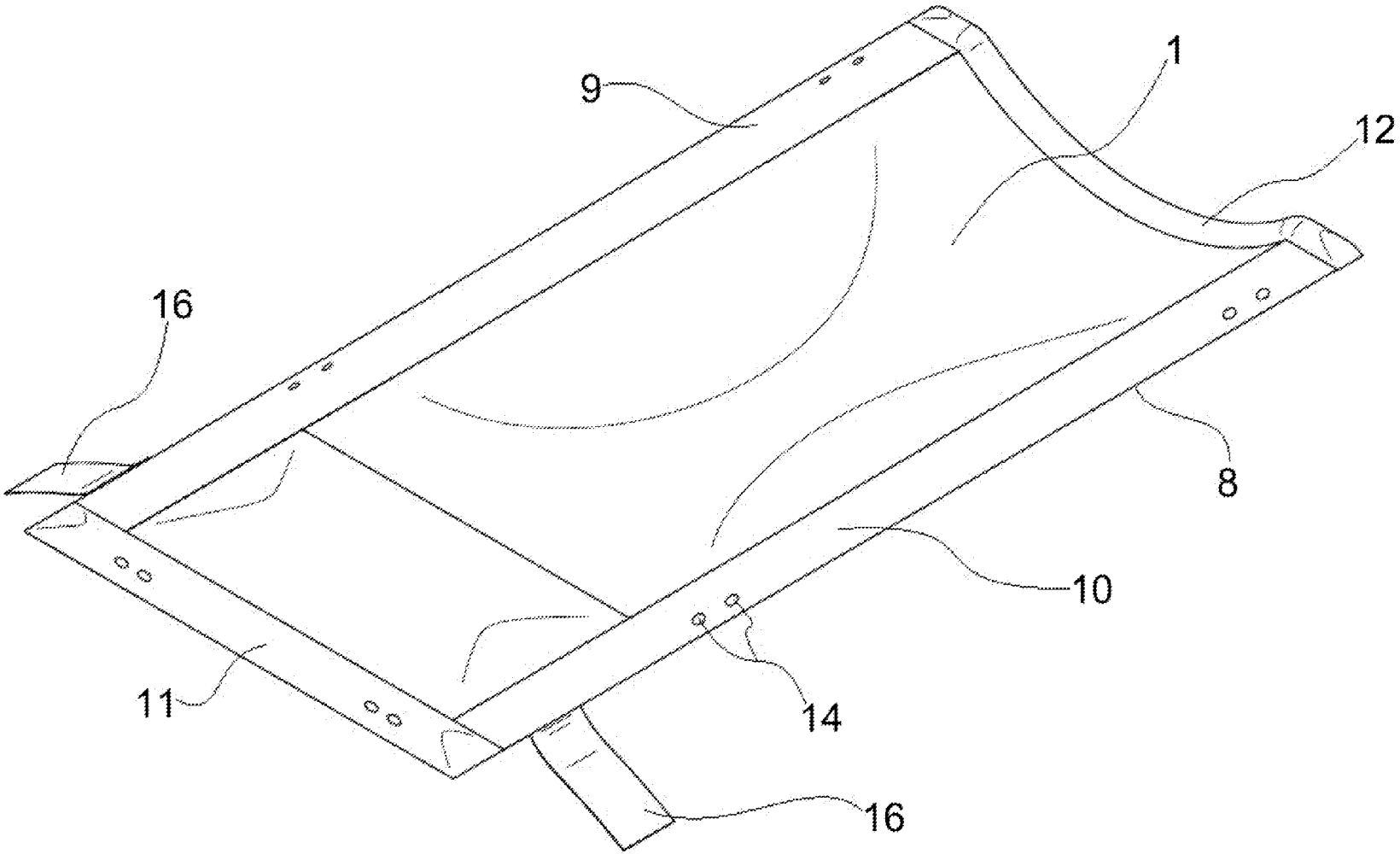
FIG. 4 illustrates an embodiment of an insert.

As exemplified in FIG. 4, in some configurations, a loop can be secured to an insert using one or more apertures which can receive a loop, such as, for example, a pair of apertures 14 in the frame 8 through which a loop can be threaded. In some configurations, a left panel 9, a right panel 10, front panel 11, and a rear panel 12 can be about two inches in width. In various configurations, a bed insert 1 can be made from bedding material. In various configurations, each panel 9-12 can independently comprise zero, one, two, or three pairs of apertures. In some aspects, front panel 11, left panel 9, right panel 10, and rear panel 12 can each comprise two pairs of apertures. In some aspects, front panel 11, left panel 9, and right panel 12 can each comprise two pairs of apertures. In various aspects, bedding material can be any type of suitable bedding material such as, for example, a quilted material, a hypoallergenic material, and/or polyfill. In various configurations, a bed insert 1 and a base 2 can be attached, and can have the dimensions, in non-limiting example, of about 34 inches by 17 inches by 5.5 inches.

Figure 5:
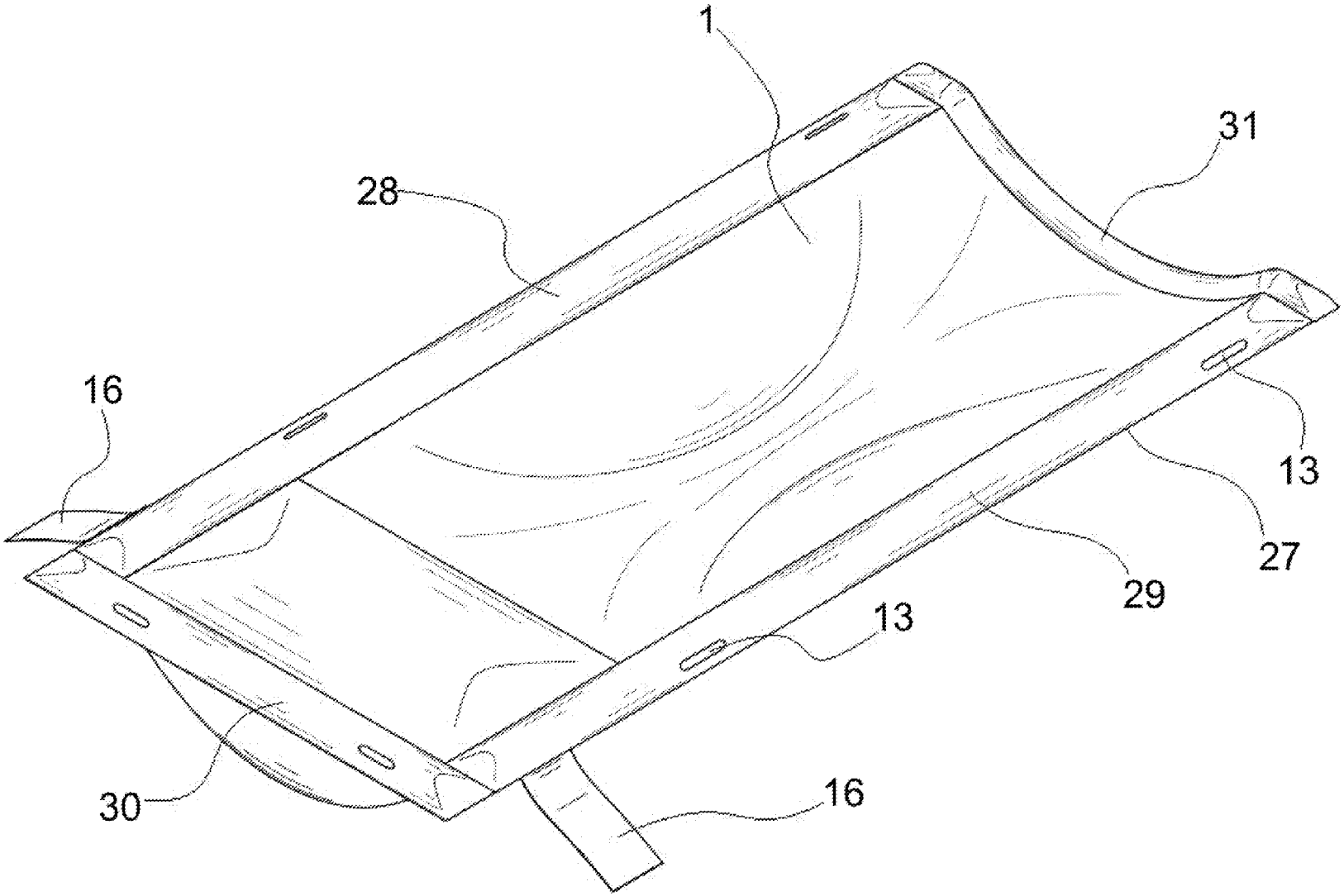
FIG. 5 illustrates an embodiment of an insert.

In various configurations, a bed insert 1 and a base 2 can be detachably attached to each other as illustrated in FIG. 3, FIG. 4 and FIG. 5. In some configurations, a bed insert 1 as shown in FIG. 3 can be secured to a base 2 by an attachment such as one or more pieces of Velcro 15 secured to the base and the insert, and/or one or more catch clips 16. In various aspects, Velcro 15 can be one or more strips of convenient length, e.g., from about 2 inches in length up to about 9 inches in length, such as 2, 3, 4, 5, 6, 7, 8 or 9 inches in length.

As exemplified in FIG. 5, in some aspects, a bed insert 1 can comprise one or more slots 13 in panels comprising frame 27. In various aspects, each slot can reversibly secure an openable loop. In various aspects, each slot 13 can be configured to receive an openable loop. In various configurations, each panel 28-31 can independently comprise zero, one, two, or three slots. In some aspects, front panel 30, left panel 28, right panel 29, and rear panel 31 can each comprise two slots. In some aspects, front panel 30, left panel 28, and right panel 29 can each comprise two slots. In some aspects, a bed insert 1 can include one or more straps or catch clips 16 that are attached to left panel 9 and right panel 10. In some configurations, one or more straps or catch clips 16 can each be from about 5 to about 6 inches in length. In some configurations, left panel 9 and right panel 8 can be of equal length. In various configurations, left panel 9 and right panel 8 can each be from at least 20 inches in length up to 80 inches in length. In various configurations, left panel 9 and right panel 8 can each be from at least 16 inches in length up to 30 inches in length.

Figure 6:
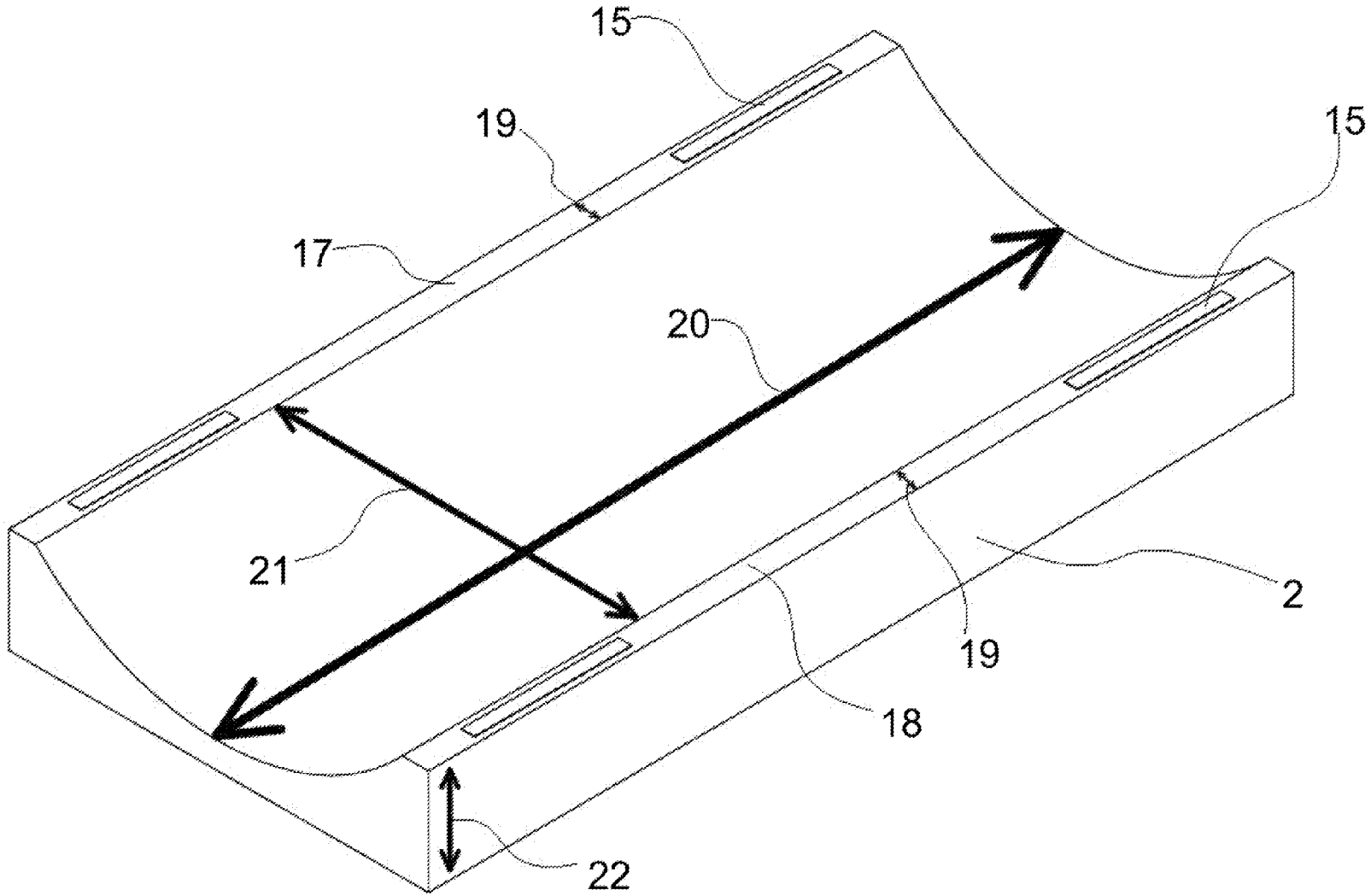
FIG. 6 illustrates an embodiment of a base.

A base 2, as exemplified in FIG. 1, FIG. 2, or FIG. 3, is further illustrated in FIG. 6. In various configurations, a base comprises a left side lip 17 and a right side lip 18. In various configurations, left side lip 17 and right side lip 18 can each be about 1 inch in width 19. In various configurations, lips 17 and 18 can each comprise one or more Velcro strips 15. In some configurations, a base 2 can comprise at least two Velcro strips 15 on each of lips 17 and 18. In some configurations, an insert can comprise Velcro strips that correspond to those of a base (FIG. 3). In some configurations, a base 2 can be from 20 inches up to 80 inches in length 20. In some configurations, a base 2 can be from 12 inches up to 30 inches in width 21. In some configurations, a base 2 can be from 2 inches up to 8 inches in depth 22. In some configurations, a base 2 can have dimensions of about 32 inches 20 by about 16 inches 21 by about 4 inches 22. For both the base and the insert, dimensions appropriate for the size of an intended patient can be determined by a skilled artisan without undue experimentation.

Figure 7:
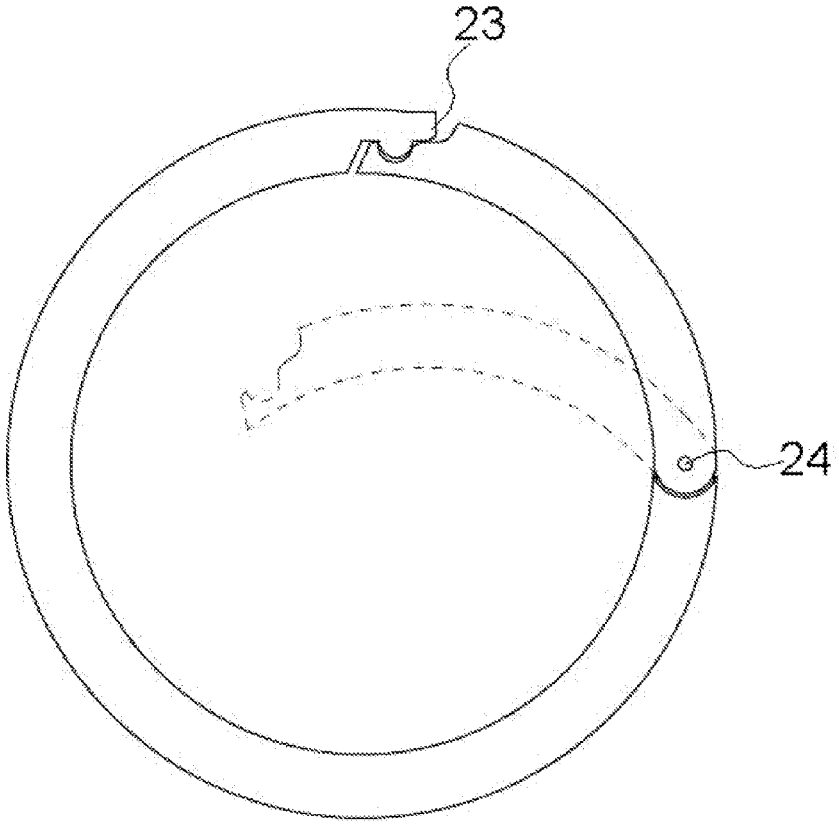
FIG. 7 illustrates an example of a clip that can be used as a loop or ring in various configurations of the present teachings.
Figure 8:
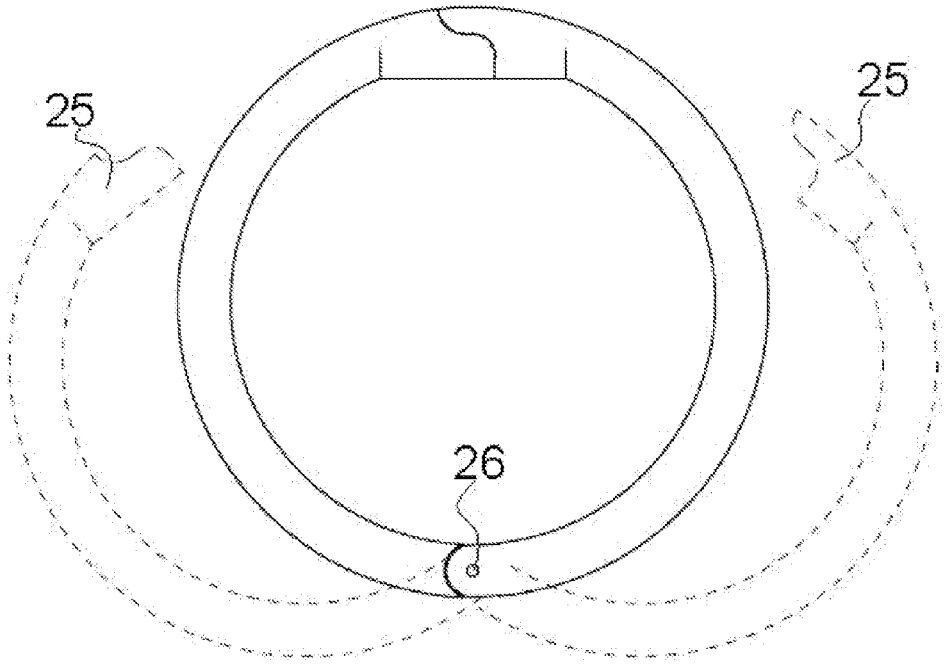
FIG. 8 illustrates an example of a clip that can be used as a loop or ring in various configurations of the present teachings.

Various configurations of an openable loop 3 are further exemplified in FIG. 7 and FIG. 8. An openable loop of these configurations can be, for example and without limitation, a ring or can have a non-circular shape such as a substantially rectangular shape. In various aspects, an openable loop comprise a solid material such as plastic, metal, or a combination thereof. In various aspects, an openable loop comprise a solid material such as polished plastic. In various configurations, an openable loop can be an openable clip. Non-limiting examples of openable clips include a pin-and-clip snap lock 23 or a hinged clasp 25, 26. In some configurations, a pin-and-clip snap lock can comprise a spring hinge 24. In various configurations, an openable loop can be an openable ring of from about 1 inch in diameter to about 4 inches in diameter, such as, without limitation, an openable ring having a diameter of 1", 2", 3", or 4". In various configurations, an openable loop can receive flexible tubing, wires, cables, or other medical lines when open, and can be closed around the lines. In various configurations, flexible tubing can be medical plastic tubing. In various configurations, an openable loop can comprise polished plastic to reduce friction between the loop and a medical line.

EXAMPLES

The following examples are set forth to illustrate various embodiments, configurations and aspects of the present teachings, and are not intended to limit the scope of any claim.

Example 1

This example illustrates use of a bed of the present teachings. As illustrated in FIG. 1, a pediatric patient 4 receiving treatment in a hospital setting has tubing 5, wires 6, and other lines 7 attached to its body. Each of these lines has been passed through a loop 3. Although the insert includes a plurality of loops, not all loops need to include a line. Furthermore, the loops are detachably attached to the insert; unused loops can be removed. Because the loops are openable, a care provider or other person attending the patient can pass a line through a loop, or remove a line from a loop as necessary.

Example 2

This example illustrates further use of a bed of the present teachings. In this example, an individual, such as a parent, can lift and hold a pediatric patient 4 receiving treatment in a hospital setting as illustrated in FIG. 1. Because the child is lifted along with the insert including the loops, the parent can hold the child without disrupting connections between medical lines and the patient's body.

Example 3

This example illustrates further use of a bed of the present teachings. In this example, an individual, such as a caregiver, a spouse, or an adult child of an elderly individual or a military veteran, can lift and hold the patient. The patient can be placed back onto the base at the end of a visit, without disrupting connections between the medical lines and the patient's body.

Example 4

This example illustrates further use of a bed of the present teachings. In this example, a hospital staff member, such as a nurse or orderly, transfers a patient, along with the insert, to an imaging system such as an MRI scanner. The transfer is accomplished without disrupting medical lines attached to the patient's body. Medical lines, such as an intravenous line supplying a fluid to the patient, can remain attached throughout the procedure. Because the insert is made entirely of non-metal parts, the scan can be accomplished without the insert interfering with the imaging process. Furthermore, a physician or other caregiver such as a radiology technician can administer a contrasting agent to the patient, and can use a line already attached to the patient for this purpose. After completion of the scan, the patient is returned to the hospital bed, without disrupting any of the medical lines.

Example 5

This example illustrates further use of a bed of the present teachings. In this example, an injured person such as wounded war veteran who received emergency care including an intravenous line can be transferred from an vehicle such as an ambulance or a transport plane to a hospital bed along with an insert of the present teachings. Use of an insert of the present teachings can reduce risk of disrupting an intravenous line during transfer of such an individual, and can allow medical personnel to provide care with enhanced speed and efficiency.

Example 6

This example illustrates further use of a bed of the present teachings for facilitating parent-child interactions in a hospital setting. In this example, a pediatric patient receiving treatment at a hospital can have various lines attached to its body which pass through loops of an insert, as exemplified in FIG. 1. A caregiver such as a nurse can lift the pediatric patient from the bed, along with the insert. The caregiver can then transfer the patient along with the insert to a visitor such as a parent. After close interactions between parent and child, the parent can transfer the child back to the caregiver who can then place the child back in its bed; alternatively, the parent can place the child directly back in its bed. Such transfers can be achieved while lessening risk of displacement of the medical lines.

All references cited in this specification are hereby incorporated by reference. Any discussion of references cited herein is intended merely to summarize the assertions made by their authors and no admission is made that any reference or portion thereof constitutes relevant prior art. Applicants reserve the right to challenge the accuracy and pertinency of the cited references.

What is claimed is:

1. A bed insert comprising:

a bed frame comprising a front panel, a left panel, a right panel and a rear panel;

a substantially rectangular bedding material situated between the bed frame panels and configured to support a patient;

at least one panel comprising at least one slot that is substantially parallel to a longitudinal edge of said panel;

at least one plate comprising two apertures configured to reversibly receive an openable loop in a substantially vertical position;

for each plate, a bolt and a nut configured to secure the at least one plate to a panel; and one or more openable loops reversibly attached thereto, wherein the one or more loops is of a sufficient size to allow for free movement of at least one line therethrough.

2. A bed insert in accordance with claim 1, wherein at least one loop of the one or more openable loops is an openable ring comprising plastic, metal or a combination thereof.

3. A bed insert in accordance with claim 1, wherein at least one loop of the one or more loops is an openable ring comprising plastic.

4. A bed insert in accordance with claim 1, wherein at least one loop of the one or more loops is an openable ring comprising polished plastic.

5. A bed insert in accordance with claim 1, wherein at least one loop of the one or more loops is an openable clip.

6. A bed insert in accordance with claim 5, wherein the openable clip is selected from the group consisting of a hinged clasp and a pin-and-clip snap lock.

7. A bed insert in accordance with claim 6, wherein the pin-and-clip snap lock comprises a spring hinge.

8. A bed insert in accordance with claim 1, wherein a loop is an openable ring of about 1" in diameter, from 1" in diameter to 6" in diameter, or about 6" in diameter.

9. A bed insert in accordance with claim 1, wherein the left panel and the right panel are each from at least 20" up to 80" in length.

10. A bed comprising:

the bed insert in accordance with claim 1; and a base comprising a left side and a right side.

11. A bed in accordance with claim 10, wherein the left side and the right side of the base each comprises a lip.

12. A bed in accordance with claim 10, further comprising one or more pieces of VELCRO hook-and-loop fastener secured to the insert and one or more pieces of VELCRO secured to the base.

13. A bed in accordance with claim 10, wherein the insert and the base are attached by a reversible attachment selected from the group consisting of VELCRO hook-and-loop fastener, a catch latch and a combination thereof.

14. A bed in accordance with claim 10, having dimensions of about 34" by about 17" by about 5½".

* * * * *